United States Patent [19]

Delamare

[11] Patent Number: 4,665,855

[45] Date of Patent: May 19, 1987

[54] SWIVEL SYSTEM FOR CONNECTING THE MOORING ARM OF A FLOATING FACILITY TO A MARINE STRUCTURE

[75] Inventor: Guy R. Delamare, Herblay, France

[73] Assignee: Technip-Geoproduction, Paris, France

[21] Appl. No.: 749,305

[22] Filed: Jun. 27, 1985

[30] Foreign Application Priority Data

Jun. 27, 1984 [FR] France ..... 84 10125

[51] Int. Cl.[4] ..... B63B 21/52

[52] U.S. Cl. ..... 114/230; 441/4

[58] Field of Search ..... 114/230, 219; 441/3–5; 384/221

[56] References Cited

U.S. PATENT DOCUMENTS 3,522,787 8/1970 Tam ..... 441/4 X
4,084,801 4/1978 Landers et al. ..... 114/219 X
4,359,959 11/1982 Delamare ..... 114/230
4,439,055 3/1984 Quigg et al. ..... 403/330
4,480,575 11/1984 Delamare ..... 114/230

*Primary Examiner*—Sherman D. Basinger
*Attorney, Agent, or Firm*—Antonelli, Terry & Wands

[57] ABSTRACT

A suitable system for connecting an anchored marine structure and a rotating moor arm of a floating facility in which a swivel combines for connecting the marine structure and the mooring arm has at least one plain journal bearing with at least one elastic pad arranged about the axis of the bearing such that the rotation of the mooring arm about the marine structure is achieved. Initially, rotation is achieved for large angular motions and significant rotations in particular those exceeding one complete turn by sliding of the journal bearing and secondly, for small alternating angular motions by elastic deformation of the pad. The stiffness of the pad is such, compared with the coefficient of friction of the journal bearing that the sliding threshold of the bearing is not reached.

13 Claims, 5 Drawing Figures

SWIVEL SYSTEM FOR CONNECTING THE MOORING ARM OF A FLOATING FACILITY TO A MARINE STRUCTURE

BACKGROUND OF THE INVENTION

This invention relates to a swivel system particularly suited to the mooring of a floating facility to a marine structure with a virtually fixed position relative to the seabed and to which the floating facility is secured through a rigid arm.

The floating facility may be a ship and the marine structure a mooring buoy anchored at a distance from shore. The marine structure may also be a tower, a dolphin, an articulated leg, a buoyant column, a mooring trunk, a tank, etc. It may also be a buoy for loading and/or unloading ship cargo, a facility from which operations such as seabed drilling, oil recovery, etc. are carried out or controlled.

The floating facility may also be a plant for the recovery of thermal energy from seas or a floating oil processing and storage plant.

In most cases, the swivel system has to transmit important forces while allowing relative free movement between the arm of the floating facility and the marine structure. Such freedom of motion is required to allow for the dynamic attack by wind, wave and currents.

Wave action requires firstly free nutation movement about a vertical axis to cater for the floating facility roll, pitch and heave and secondly free swaying movement in a horizontal plane for small alternating motions. Wind and current direction variations require that the floating facility be able to weathervane about the marine structure which is in a fixed position relative to the seabed, the swivel joint allowing a rotation of more than one full turn.

Swivel systems are already in use for ship mooring to structures such as trunk buoys or articulated legs which provide the above defined freedom of motion. These systems are based on ball or roller bearings and combine a guide ring or turntable with a vertical axis and a universal coupling pivoting about two perpendicular horizontal axes.

Other systems with the same geometry are also in use which are based on journal bearings with lubricated copper alloy bushings.

Such systems are little suited to the particular stresses imposed by marine environment on such facilities.

Ball and roller bearings are designed for continuous running and their operation is upset by the slightest corrosion.

Under offshore conditions, movements are slow and with small amplitudes and fatigue stresses are constantly applied to the same area of the bearing which is only subjected to small alternating motions with an amplitude less than 10°. Also, corrosion due to marine environment is severe.

Journal bearings with copper alloy bushings are generally subject to rapid wear thus increasing running play which in turn prompts wear due to the smaller area which is in contact with the shaft. Frequent replacements are required. Maintenance operations at sea are difficult and cost intensive, especially when, as this is the case with oil recovery facilities, they involve oil production disruption.

The prior art may be illustrated by the following french patent FR-A No. 2 171 478 and the following U.S. Pat. Nos. 3,614,869, 4,262,380, 4,494,475, 4,439,055 and 4,435,097.

SUMMARY OF THE INVENTION

On the other hand, the system of this invention provides a clearance free joint whose most components are not subject to corrosion, wear or fatigue when submitted to repeated small amplitude alternating motions. Moreover, with this system, the use of wearing components concerns only a very small part of the joint movements and thus fully dispenses from maintenance or material replacement throughout the period of utilization of the marine structure which may extend over several years.

The main object of this invention is to provide a new swivel joint between an anchored marine structure and a rotating mooring arm that be particularly well suited to the nature of stresses imposed by offshore environment and that would not require any maintenance over a long period of offshore service.

The system provided by this invention behaves virtually as a ball joint. In this system a plain journal bearing, whose bushings may be lubricated, located at the top of a marine structure such as an anchored articulated or buoyant column, is associated with a deformable joint whose laminated structure consisting of stacked flexible and rigid spherical shells, transmits the forces generated by the marine environment while permitting of all the degrees of freedom provided by a ball joint, so that the rotation of the floating facility mooring arm is obtained firstly for large angular motions and rotations exceeding one full revolutions, by the sliding of the journal bearing and secondly, for small alternating angular motions, which statistically are the most frequent ones, by the mere elastic deformation of the laminated structure.

This invention provides a swivel joint between an anchored marine structure and the rotating mooring arm of a floating facility characterized by the fact that this system combines, for connecting the marine structure and the mooring arm, at least one journal bearing and one elastic pad arranged about the axis of said bearing and such that the rotation of said mooring arm about the said marine structure is obtained, first, for large angular motions and significant rotations, in particular those exceeding a complete revolutions, by the sliding of the said journal bearing, and secondly, for small alternating angular motions, which statistically are the most frequent ones, by the more elastic deformation of the said pad, whose stiffness is such, compared with the coefficient of friction of the said journal bearing, that the sliding threshold of said bearing is not reached.

At least one pad, included in the joint, may have a laminated structure comprising stacked rigid spherical shells and spherical shells made of elastically deformable material, each of the said shells made of elastically deformable material being sandwiched between two rigid shells to which it adheres.

According to an alternative of the system subject of this invention, the elastic pad is arranged radially about the axis of the journal bearing so that the shell spheres comprising the said pad have a common center around which a rotational motion may be obtained in three perpendicular directions by shear deformation of the flexible material of said shells.

The system subject of the invention may include several elastic pads which elastic pads may be mounted with compressive preloading between an outer annular structure centered on the bearing axis and two inner rings coaxial with the said annular structure, and arranged about the equatorial plane of the shell spheres comprising the said pad which plane is perpendicular to the said axis, so that the axial components opposing the forces tending to relieve the said elastic pads of the preload tend to bring the said inner rings together.

The bushings supported by the inner rings can co-act with a biconical hub located at the top of the marine structure so that the forces bringing the inner rings together as a result of the preloading of the elastic pads, maintain a clearance free contact between the said bushings and the said biconical hub and automatically take up any wear play.

Compressive preloading of elastic pads may be achieved by locking in a suitable position sliding elements interposed between the said elastic pads and the outer annular structure, sliding being allowed in radial directions in relation to the center of the said pad shell spheres.

The sliding means permitting the compressive preloading of the elastic pads may comprise a series of cylindrical bores provided in the outer annular structure co-acting with flanged cylindrical elements extending the said pads, thelocking of said cylinders in a suitable position being achieved by tightening a ring of screws interposed between the said annular structure and the flange of each cylinder.

According to an alternative of the said system, it includes a driving pin integral in rotation with the said arm, which, after maximum allowable deformation of the elastic pads, is brought into contact with at least one stop halting the said pin and integral with the said bearing to permit direct transmission of the rotational motion and cause the journal bearing to slide.

The biconical hub co-acting with the bushing support rings of the journal bearing, may include along its axis a cylindrical hole accommodating piping conveying variable temperature pressure fluids, the mobility of the rings of the said bearing allowing take up of the play resulting from dimensional variations due to thermal expansion.

The outer annular structure supporting the elastic pads can be connected to the rotating mooring arm of the floating facility by means of a hinge with an axis parallel to the hinge providing the joint between the said arm and the said floating facility.

The hinge connecting the annular structure to the rotating mooring arm may comprise two pins fixed into the said structure, each co-acting with a radial bearing and a thrust bearing solid with each of the ends of a fork terminating the said arm on the side opposite to the hinge connecting it to the floating facility.

The radial bearing may comprise stacked rigid cylindrical ferrules and elastically deformable cylindrical ferrules bonded to each other, and the thrust bearing may comprise stacked rigid discs and discs made of elastically deformable material, bonded to each other, the freedom of rotation of the hinge being achieved by the shear deformation of the elastic material of the said ferrules and discs. Finally an elastomer could be used to advantage as the elastically deformable material for the spherical shells comprising the elastic pads and for the cylindrical ferrules and discs comprising the radial and thrust bearings.

The characteristics and advantages of the invention will be best understood when reading the description that follows of an embodiment of the invention and referring to the attached drawings where :

DETAILED DESCRIPTION OF THE INVENTION

Figure 1:
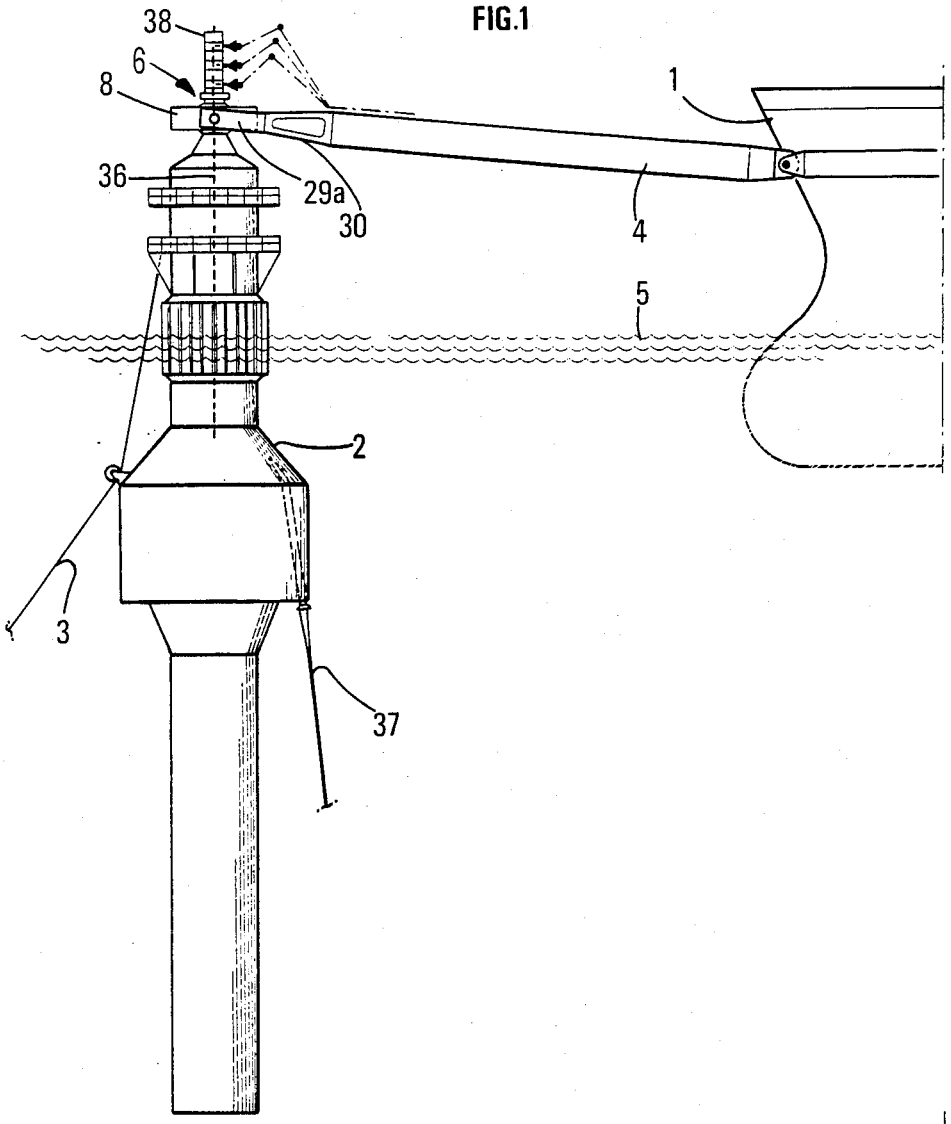
FIG. 1 is an elevation view of the mooring of a ship to an anchored buoyant column.
Figure 2:
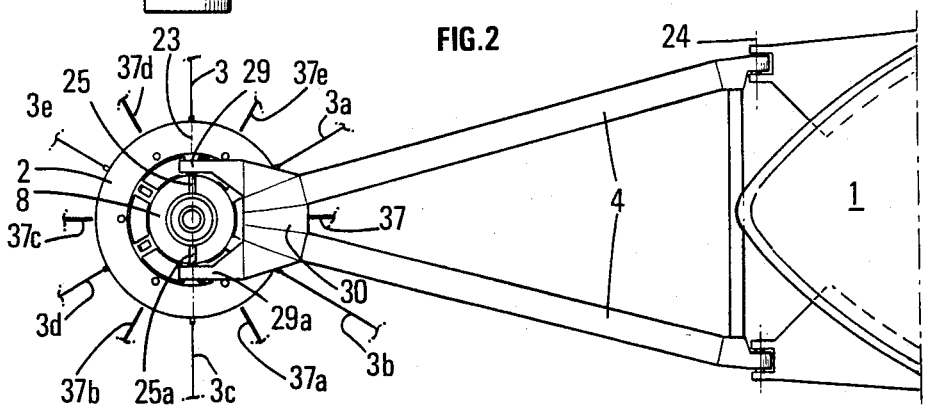
FIG. 2 is a plan view of the same

FIG. 1 and 2 show a mooring system assembly wherein a floating facility 1 such as a ship, is moored to a marine structure such as a buoyant column, anchored to the seabed by funicular anchor cables such as 3, 3*a*, 3*b* and 3*c*, by means of a rigid arm 4, the water line being schematically shown by line 5. The connecting joint between arm 4 and the top of column 2 includes a journal bearing 6 whose axis is vertical and at least one elastic pad 14 located between this bearing and an annular structure 8.

Figure 3:
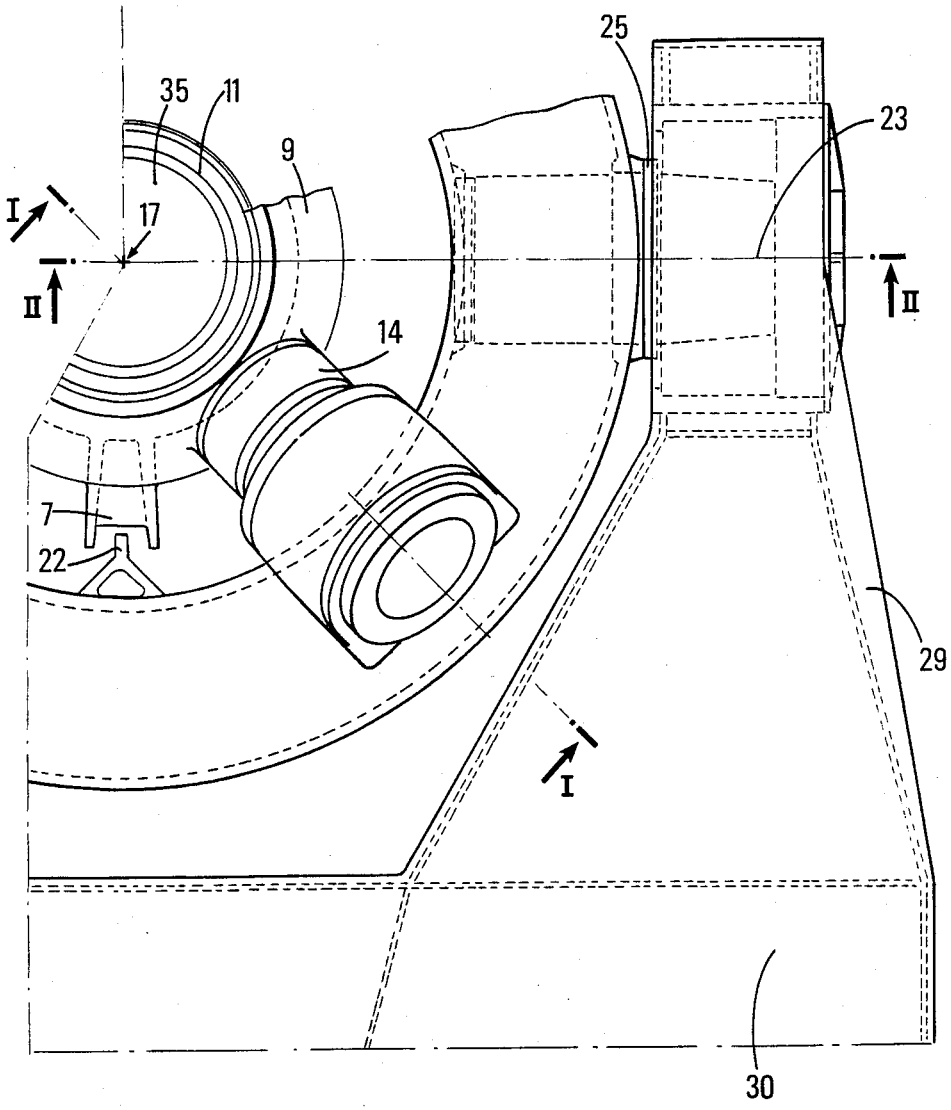
FIG. 3 is a partial plan view of an enlarged detail of FIG. 2, showing a particular embodiment of the joint according to the invention.
Figure 4:
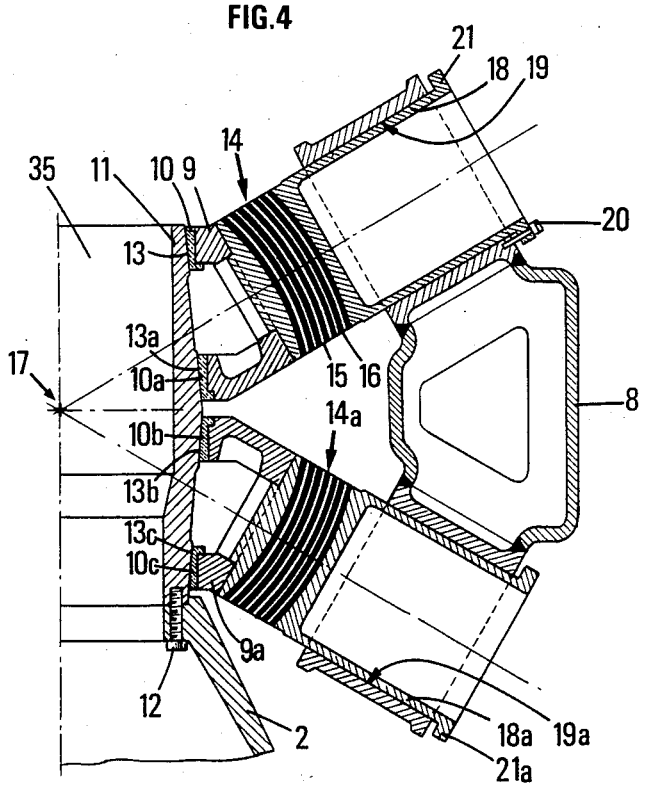
FIG. 4 is a sectional view along line I of FIG. 3.
Figure 5:
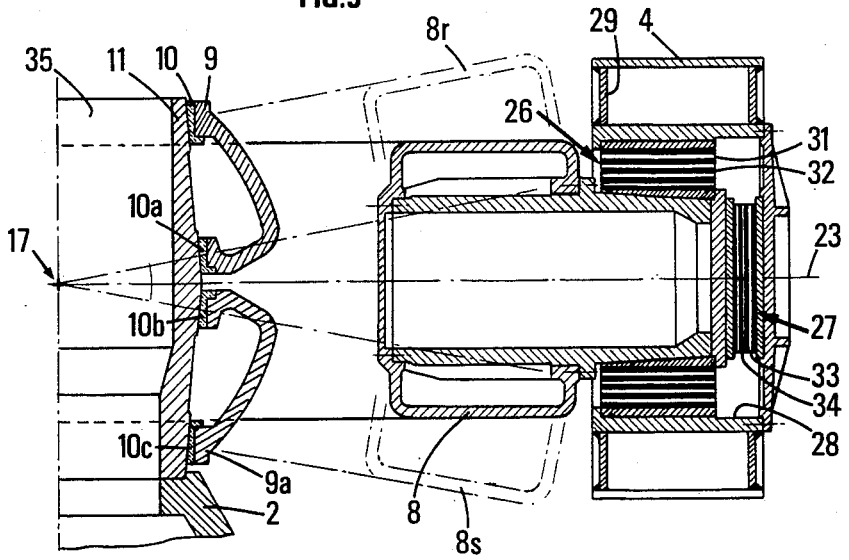
FIG. 5 is a sectional view along line II of FIG. 3.

FIGS. 3, 4 and 5 show the details of a method of embodiment of a joint in accordance with the invention wherein the journal bearing 6 comprises two identical rings 9 and 9*a* arranged symmetrically and supporting each two tapered bushings 10, 10*a* and 10*b*, co-acting with a biconical hub 11 situated at the top of the column 2, to which it is clamped by srews 12. Tapered areas 13 and 13*a*, and the one hand, and 13*b* and 13*c* on the other hand, that constitute the journals in contact with bushings 10 through 10*c* on hub 11 have opposite bases. A plurality of elastic pads such as 14, 14*a* are arranged radially between the annular structure 8 and each bushing support ring 9 and 9*a*. Each elastic pad has a laminated structure consisting of stacked rigid spherical shells such as 15 and spherical shells made of a flexible, preferably elastomeric, material such as 16, the flexible shells being sandwiched between two rigid shells to which they are bonded by gluing for example. The various pads 14, 14*a* etc. are positioned in relation to each other in such a way that the shell spheres comprising them have a common center 17, which provides free rotational motion in three perpendicular directions by shear deformation of the flexible material of the shells.

In the example illustrated on FIGS. 3 and 4, elastic pads 14, 14*a* etc. have a circular contour and are extended by cylinders 18, 18*a* etc. . . which can slide in bores 19, 19*a* etc. . . provided in the annular structure 8. This arrangement allows, firstly, easy assembly and disassembly of the pads by introduction from the outside of annular structure 8, and secondly, compressive preloading of the elastomeric shells such as 16, by tightening a ring of screws 20 interposed between flanges 21, 21*a* of cylinders 18, 18*a* etc. and annular structure 8.

This compressive preloading which may reach half the maximum load applied on a pad has a twofold objective. Firstly, it prevents tensile stressing of the pads which would cause rupture of the assembly made up of the spherical flexible and rigid lamellae bonded to each other. Secondly, it generates a permanent force tending to bring together the two rings 9 and 9*a*, thus maintaining a clearance free contact between bushings 10 through 10*c* and conical journals 13 and 13*c* of hub 11, and automatically taking up any wear play.

The use of the ring of screws 20 for compressive preloading of the elactic pads is indicated as an example only, as other systems may be used such as, for instance, a hydraulic jack which is not shown here.

The flexible connection provided between the annular structure 8 and the support rings 9 and 9a of the journal bearing 6, by the pads 14 is complemented by a mechanical system for driving these rings which comes in operation upon the rotation of arm 4 about column 2. When the elastic pads reach their yield value, i.e. for instance, of about 10°, of annulus 8 on arm 4, about bearing 6 on column 2, the driving pin 22 integral with the annulus 8 meets the two stops 7 limiting the motion of the said pin, which are integral with the rings 9 and 9a, and thus causes bushings 10 through 10c to slide on hub 11. The stiffness to shear deformation of the elastic pads 14, 14a etc. is chosen at a value such, compared with the coefficient of friction of bushings 10 through 10c on journals 13 through 13c of hub 11, that the sliding threshold 15 not reached for an angle of rotation of arm 4, about column 2, corresponding to the small alternating angular motions of less than 10° generated by swell, which statistically are the most frequent ones and account for about 90% of all the motions imposed on the facility.

To the best advantage, the strutural annulus 8 can be connected to the arm 4 as shown on FIG. 2, 3 and 5, by a hinge whose axis 23 is parallel to the axis 24 of the hinge joint between the arm 4 and the ship 1.

This hinge consists of two pins 25 and 25a fixed into ring 8, each co-acting with a radial bearing 26 and a thrust bearing 27, encased in cylindrical housing 28 provided in either ends 29 and 29a of a fork 30 terminating arm 4. Each radial bearing 26 consists of stacked rigid cylindrical ferrules 31 made, for example, of steel, and elastomeric cylindrical ferrules 32 bonded to each other and each thrust bearing 27 consists of stacked rigid discs 33 made, for instance, of steel and elastomeric discs 34 bonded to each other. Free rotation of the hinge is achieved by the torsional deformation of radial and thrust bearings which results from the shear flexibility of the elastomeric ferrules and discs.

Also the hub 11 of bearing 6 can be drilled in its center to advantage to provide a cylindrical hole 35 for the passage of piping 36 conveying variable temperature pressure fluids that rise from wellheads, (not shown), installed on the seabed, through flexible piping 37 and across colum 2 up to the swivel joint 38, through which fluids are transferred towards arm 4 and ship 1.

The operation of the above described system is easy to understand.

When under the effect of orbital wave movements acting on ship 1 and on the anchored column 2, these are subjected to surge pulses tending to bring them closer or apart, or when under the conjugated effects of wind and current, the ship 1 tends to move away from the anchored column 2, there result connection stresses opposing the displacements which are transmitted to the joint by arm 4. These stresses are transferred as compressive stresses first to bushings 10 through 10c, secondly to part of the elastic pads, 14, 14a etc. . . , radial bearings 26 and axial thrust bearings 27. The spherical, cylindrical or flat lamellae incorporated in these three deformable components are subjected to compression stresses according to their thicknesses and the incompressible elastomer of which they are made, being stabilized by the rigid steel lamellae to which it adheres over a large area, cannot creep towards its periphery in a direction perpendicular to the stress and can then safely withstand very heavy loads.

When, column 2 being assumed to be in a virtually fixed position, the ship 1 transmits to arm 4 her roll motion, this motion is imposed by fork 30 to the structural annulus 8 through pins 25 and 25a of the hinge with axis 23 and through compressively loaded radial bearings 26. Elastic pads 14 are subjected to bending stresses and each one of the spherical elastomeric shells comprising them such as 16, undergoes a shear deformation so that the rigid shells such as 15 can slide in relation to one another, in such a way that ring 8 be free to rotate about the common center 17 of the shell spheres to reach the extreme positions 8r and 8s imposed by the roll motion. A compromise between the load take up capacity and the deformability of elastic pads 14 generally limits their deflection to an angle in the order of magnitude of ±10°, which is sufficient with respect to roll, taking into account extreme sea states.

When the column 2 and the ship 1 are subjected to heave and pitch motions, the oscillations of arm 4, in relation to said column, about rotation axis 23, often require, in extreme sea states, a freedom of deflection more important than for roll, in the order of magnitude of 30°, for instance, and the yield value of the elastic pads which is 10°, is not sufficient. This is the reason why the elastic pad system has been combined with a second system consisting of deformable bearings such as 26 and 27 whose allowable deflection can be in the ordre of magnitude of ±20°, for instance, the total deflection of the joint in this direction being obtained by adding the deflections of the two systems.

At least one of the two systems may be equipped with stops intended to limit deflection. Such stops will preferably be fitted on the more flexible system.

Axial thrust bearings such as 27 are intended to take up the stresses applied by arm 4 on column 2, transversally to the axis of ship 1, due to the yawing motions of said ship.

When the wind maintains the ship 1 in a director different from that of the waves, she is subjected to small swaying motions around the vertical axis of column 2 which are transmitted by arm 4 to the joint.

These small motions, whose amplitude is generally less than ±10° are statistically very frequent and are generally considered to account for 90% of the motions around the vertical axis of the column. They are taken up in whole by the deformability of elastic pads 14, 14a etc. which is virtually equal with regard to roll, pitch and heave since the flexible and rigid spherical shells comprising them are concentric and allow of the same deflection in rotation according to three perpendicular directions about point 17.

The shear stiffness of the assembly of elastomeric shells such as 16 comprising the elastic pad system is chosen with a value such that for small swaying motions, the sliding threshold of bearing 6 is not reached. This threshold will only be exceeded for deflections exceeding 10° which, generally, only account for about 10% of all swaying motions.

As a matter of fact, the use of journal bearing 6 remains necessary mainly when wind and/or current directions change and when ship 1 rotates about the axis of column 2 and takes a new position. Deflections may then by far exceed 10°, and even, after several changes in wind and current directions, exceed a complete turn.

In that case, elastic pads 14 are subjected to deformation until their stiffness which is proportional to the angle of twist imposed by the arm, becomes such that the sliding threshold of bearing 6 is reached and rings 9 and 9*a* become driven and rotate about hub 11.

With a view to protecting pads 14 in the event that the coefficient of friction of bushings 10 through 10*c* on hub 11 could not be known accurately, or would change with time, rings 9 and 9*a* are driven in rotation, for instance for motions exceeding 10°, by the positive contact of stops 7 which are driven against the driving pin 22 of ring 8.

The joint can thus permit large angular motions and rotations exceeding one full revolution, without stressing pads 14 beyond their yield value.

The preload applied to pads 14 by tightening screws 20 and stored by the elastic compression of the elastomeric shells tends to bring together rings 9 and 9*a*, thus taking up any play between bushings 10 through 10*c* and journals 13 and 13*c* of hub 11.

When, after a number of large swaying motions under heavy load, bushings 10 through 10*c* are subjected to wear tending to increase running play, such play is automatically tacken up by the sliding of rings 9 and 9*a* towards the base of tapered areas 13 through 13*c* of hub 11. Periodically, to compensate relaxation of the elastomeric shells due to wear, the initial preload can be restored by acting on screws 20 or on an equivalent hydraulic system.

Also, when the fluids conveyed in piping 36 undergo significant temperature changes, the mobility of rings 9 and 9*a* permits adjustment of bearing 6 in line with the dimensional variations of biconical hub 11 due to thermal expansion and avoid the necessity of allowing for such variations by increasing the initial running clearance as would be the case with a conventional plain bearing.

The advantages of this invention mainly result from the possibility of making joints particularly well suited for the taking-up of the loads and motions generated by the action of sea elements, which joints do not require any maintenance, repair, or component replacement over many years of service at sea. This possibility results from the appropriate use of elastomer based joints capable of elastic torsional deformation, of clearance free and frictionless operation, i.e. wearless operation, and offering high fatigue strength for most motions, leaving for take up by the sliding bearing, which is more subject to wear, those few motions only which it is indispensable for it to take up.

The joint system provided by the invention applies to any system generating frequent small amplitude rotational motions along three perpendicular directions and intermittent rotations of more than one full revolution. It is particularly suitable for the mooring of a ship to an articulated leg or anchored buoyant column, especially when installing offshore oil production facilities, where the column contains flexible flowlines 37 connecting subsea wellheads and the surface and where the ship is a storage vessel equipped with product treating facilities.

I claim:

1. A swivel system for connecting an anchored marine structure and a rotating mooring arm of a floating facility, wherein a swivel combines for connecting the marine structure and the mooring arm, said system comprising at least one plain journal bearing with at least one elastic pad, arranged about the axis of the bearing such that the rotation of the mooring arm about the marine structure is achieved, firstly, for large angular motions and significant rotations, in particular those exceeding one complete turn, by the sliding of the journal bearing and secondly, for small alternating angular motions, which statistically are the most frequent, by the elastic deformation of said pad, whose stiffness is such, compared with the coefficient of friction of said journal bearing, that the sliding threshold of said bearing is not reached.

2. A swivel system, as claimed in claim 1 wherein said elastic pad, has a laminated structure comprising stacked rigid spherical shells and spherical shells made of elastically deformable material, each of said shells made of elastically deformable material being sandwiched between two rigid shells to which it adheres.

3. A swivel system, as claimed in claim 2 wherein said elastic pad is arranged radially around the axis of the journal bearing, in such a way that the shell spheres comprising said pad, have a common center around which a rotational motion may be achieved in three perpendicular directions by shear deformation of the flexible material of the shells.

4. A swivel system as claimed in claim 2 or claim 3, including several elastic pads and characterized by the fact that said elastic pads are mounted with compressive preloading between an outer annular structure centered upon the bearing axis and two inner rings coaxial with said annular structure, and arranged about an equatorial plane of the shell spheres comprising said pads which are perpendicular to the axis, so that axial components opposing the forces tending to release the preload of said elastic pads, tend to bring together said inner rings.

5. A swivel system as claimed in claim 4 wherein bushings supported by said inner rings act in conjunction with a biconical hub located at the top of the marine structure, so that the forces tending to bring together the two inner rings as a result of the preloading of the elastic pads maintain a clearance free contact between said bushings and said biconical hub and automatically take up any wear play.

6. A swivel system, as claimed in claim 5, wherein the biconical hub co-acting with the bushing support rings includes in its axis a cylindrical hole providing passage for variable temperature pressure fluid piping, the mobility of the rings of said bearing enabling its clearance free adjustment to allow for changes in dimensions due to thermal expansion.

7. A swivel system as claimed in claim 4, wherein the compressive preloading of the elastic pads is achieved by locking in a suitable position sliding means interposed between said elastic pads and the outer annular structure, sliding being achieved in radial directions in relation to the center of the shell spheres of said pads.

8. A swivel system as claimed in claim 7, wherein the sliding means enabling the compressive preloading of the elastic pads comprises a series of cylindrical bores provided in the outer annular structure co-acting with flanged cylinders extending from said pads, the locking in a suitable position of said cylinders extending from said elastic pads being achieved by tightening a ring of screws interposed between said annular structure and the flange of said cylinders.

9. A swivel system, as claimed in claim 4, wherein the outer annular structure supporting the elastic pads is connected to the rotating mooring arm of the floating facility by a hinge whose axis is parallel to the axis of a hinge providing a joint between said arm and said floating facility.

10. A swivel system, as claimed in claim 9, wherein the hinge with axis connecting the annular structure to the rotating mooring arm comprises two pins fixed into said structure, each co-acting with a radial bearing and a thrust bearing which are integral with each of the ends of a fork terminating said arm on the side opposite to the hinge with axis connecting it to the floating facility.

11. A swivel system, as claimed in claim 10, wherein the radial bearing comprises stacked rigid cylindrical ferrules and cylindrical ferrules made of elastically deformable material bonded to each other, and the thrust bearing comprises stacked rigid discs and discs made of elastically deformable material, bonded to each other, the free rotation of the hinge being achieved by the shear deformation of the elastic material of said ferrules and discs.

12. A swivel system, as claimed in claim 11, wherein the elastically deformable material of the spherical shells comprising the elastic pads, and of the cylindrical ferrules and the discs comprising the radial bearings and thrust bearings is an elastomer.

13. A swivel system as claimed in claim 1, wherein at least one driving pin integral in rotation with said arm, is brought into contact, after maximum allowable deformation of the elastic pads with at least one stop halting said pin and integral with said bearing to transmit, directly, the rotational motion and cause the journal bearing to slide.

* * * * *